United States Patent [19]

Stokes

[11] Patent Number: 4,827,540

[45] Date of Patent: May 9, 1989

[54] COMBINATION BEDPAN CUSHION AND WASTE BAG

[76] Inventor: Lillie M. Stokes, P.O. Box 178, Castalia, N.C. 27816

[21] Appl. No.: 187,778

[22] Filed: Apr. 29, 1988

Related U.S. Application Data

[63] Continuation-in-part of Ser. No. 874,718, Oct. 2, 1986.

[51] Int. Cl.[4] ..... A61G 9/00

[52] U.S. Cl. ..... 4/456; 4/451; 4/452

[58] Field of Search ..... 4/450–457

[56] References Cited

U.S. PATENT DOCUMENTS

| | | | |
|---|---|---|---|
| 2,320,845 | 6/1943 | Bolton | 4/452 |
| 2,559,246 | 7/1951 | Fees | 4/456 |
| 2,817,093 | 12/1957 | Rode | 4/456 |
| 3,061,840 | 11/1962 | Presseisen | 4/456 |
| 3,939,502 | 2/1976 | Miller | 4/456 |
| 4,011,610 | 3/1977 | Parker, III | 4/456 |
| 4,759,086 | 7/1988 | Booth-Cox | 4/452 |

FOREIGN PATENT DOCUMENTS

| | | | |
|---|---|---|---|
| 407458 | 8/1966 | Switzerland | 4/452 |

*Primary Examiner*—Henry J. Recla
*Assistant Examiner*—Robert Fetsuga
*Attorney, Agent, or Firm*—Fleit, Jacobson, Cohn & Price

[57] ABSTRACT

A disposable combination bedpan cushion and waste bag assembly having a cushion top formed into the size and shape of the seat portion of a bedpan and including a center opening similar to that of the seat portion of the bedpan. The waste bag is permanently attached to the cushion top to enclose the center opening from below. The waste bag is sealed after use. The cushion top is formed from layers of plastic-backed adhesive, rigid plastic, and cotton padding. An inner rim is provided around the inner periphery of the center opening to allow the cushion top to snugly fit onto a seat of a bed pan. In the preferred embodiment, an angular plastic clip is included as part of the assembly to secure the cushion top onto the bedpan.

13 Claims, 2 Drawing Sheets

COMBINATION BEDPAN CUSHION AND WASTE BAG

This is application is a continuation-in-part of U.S. patent application Ser. No. 874,718, filed Oct. 2, 1986, for a Lily Pad Cushioned Bed Pan Top.

BACKGROUND OF THE INVENTION

1. Field of the Invention

The present invention relates to a disposable bedpan cushion and sealable waste collection bag, and particularly to an improved bedpan cushion and sealable waste collection bag that is comfortable for a patient to use and allows for easy and sanitary disposal of waste.

2. Description of Prior Art

Bedpans are often used in hospitals by patients who are unable to use conventional toilets because, for example, they are bedridden. The bedpan is placed beneath the patient and removed after use by a hospital employee for cleaning and sanitizing.

To enhance patient comfort, disposable bedpan cushions have been designed that fit onto the seat of the bedpan. Several patents, such as U.S. Pat. Nos. 3,939,502 to Miller, 3,514,793 to West, and 3,462,770 to Smith, disclose bedpan cushions for placement on the seat portion of a bedpan. After use, such cushions are thrown away, so that a hospital employee may clean and sanitize the bedpan for reuse.

While these devices enhance patient comfort and sanitation, they do not provide for the sanitary disposal of waste material in the bedpan itself. A hospital employee must still take the pan to an appropriate disposal area, manually empty and clean the bedpan, and then sanitize the entire bedpan for use by another patient. Accordingly, a device is needed which both enables a patient to cleanly and comfortably use a bedpan and which facilitates the sanitary disposal of waste.

SUMMARY OF THE INVENTION

The present invention comprises a disposable combination bedpan cushion top and waste collection bag. The shape and size of the cushion top conforms to the seat portion of the bedpan and includes a center opening similar to the opening of the seat portion of the bedpan. The cushion top includes a rigid plastic layer with a plastic-backed adhesive on its lower surface and a cushioned layer of cotton-filled fiber on its upper surface.

A waste collection bag is permanently attached to the cushion top to enclose the center opening from below by forming a pocket for collection of waste. The waste collection bag is formed of strong plastic and includes a layer of absorbent cotton material along its inner surface adjacent its bottom. A sealing means is provided for sealing waste in the waste collection bag after use of the bedpan.

The combination bedpan cushion top and waste bag fits onto a bedpan and, after use, is completely disposable. In the preferred embodiment, a plastic angular clip is provided on the underside of the cushion to engage an inner rim of the rear portion of the associated bedpan.

It is a primary object of the present invention to overcome the deficiencies in existing disposable bedpan cushions by providing a device for use with a bedpan that is both comfortable to the user and is convenient to handle in terms of sanitation and maintenance.

It is a further object of the present invention to provide a disposable combination bedpan cushion and waste collection bag which is adaptable for use with standard bedpans of various sizes and shapes.

It is yet another object of the invention to provide a disposable combination bedpan cushion and waste collection bag which is constructed of inexpensive, disposable materials.

DETAILED DESCRIPTION OF THE DRAWINGS

Figure 1:
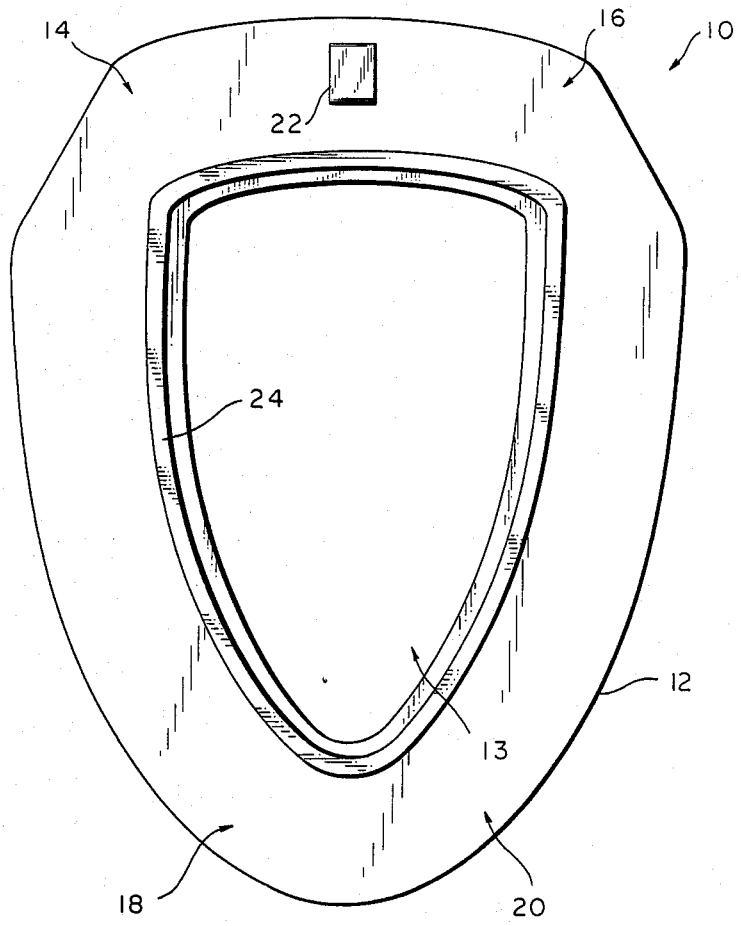
FIG. 1 is a bottom view of the combination bedpan cushion and waste bag embodying the teachings of the instant invention without the attached waste collection bag or waste bag sealing means.

Referring to the drawings in general, and to FIG. 1 in particular, the combination bedpan cushion and waste collection bag is designated as assembly 10 and, for illustrative purposes only, is shown without its permanently attached waste collection bag. A top cushion 12 conforms to the size and shape of the seat portion of a typical bedpan and includes center opening 13. Top cushion 12 includes rear end surface regions 14 and 16 and front end surface regions 18 and 20. Rear end surface regions 14 and 16 are typically wider than the corresponding front end surface regions 18 and 20. An angular plastic clip 22 is attached to the underside of the top cushion 12 between regions 14 and 16. In addition, plastic inner rim 24 is integrally provided along the inner periphery of the cushion which surrounds opening 13.

Figure 2:
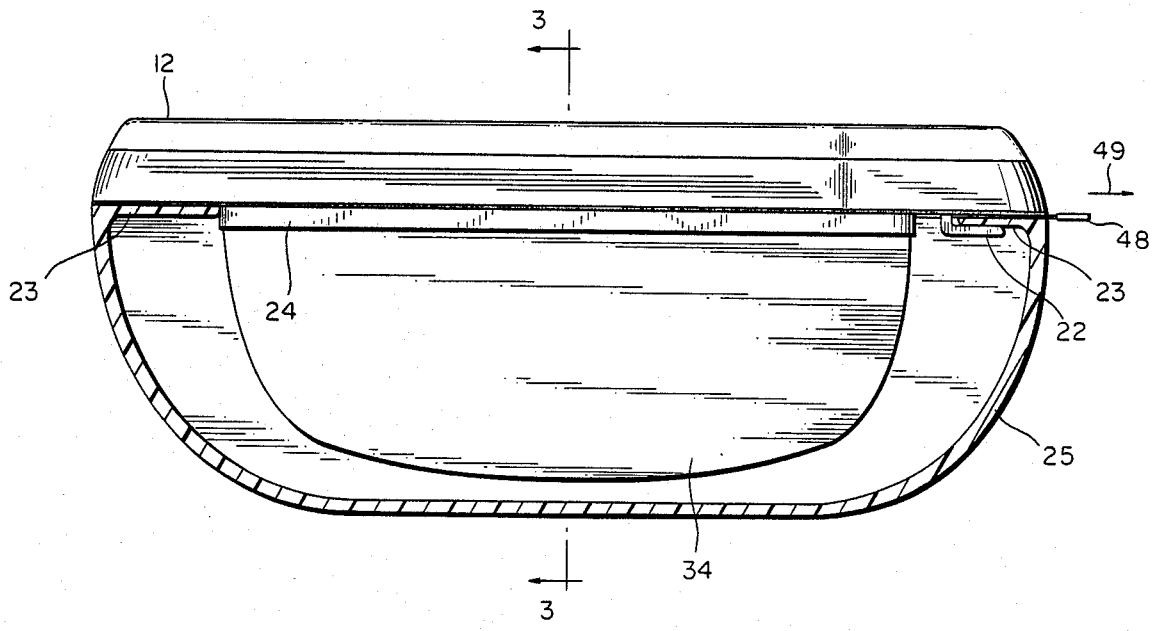
FIG. 2 is a side perspective of the bedpan cushion and waste collection bag assembly attached to a bedpan.
Figure 3:
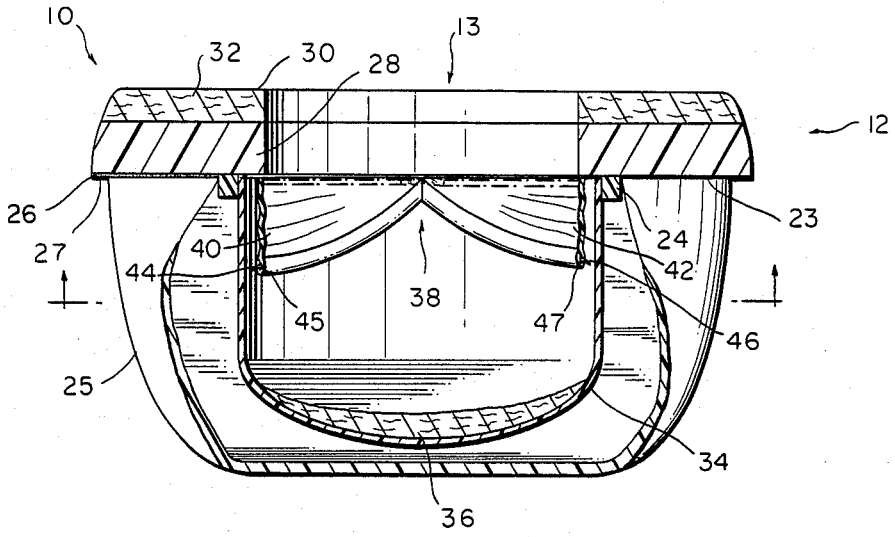
FIG. 3 is a longitudinal sectional view taken along line 3—3 of FIG. 2.

Referring now to FIGS. 2 and 3, the combination bedpan cushion and waste collection bag assembly 10 is shown attached to a standard bedpan 25. The cushion top 12 is comprised of three different layers. As shown in FIG. 3, the bottom layer of top cushion 12 consists of an adhesive coating 26 protected by a peel-away backing 27. The intermediate layer comprises a rigid plastic material 28 which preserves the shape of the cushion top 12. The top layer includes a paper sheet 30, which encloses a filling of cotton-fiber padding material 32 to provide a soft cushion.

A waste collection bag 34 is attached to the cushion top 12 at the inner rim 24 and completely encloses opening 13 from below to form a pocket for waste collection. The bottom periphery of the bag 34 includes a layer of absorbent cotton 36, while the bag is made of a strong, yet very pliable, plastic material which resists tearing.

Figure 4:
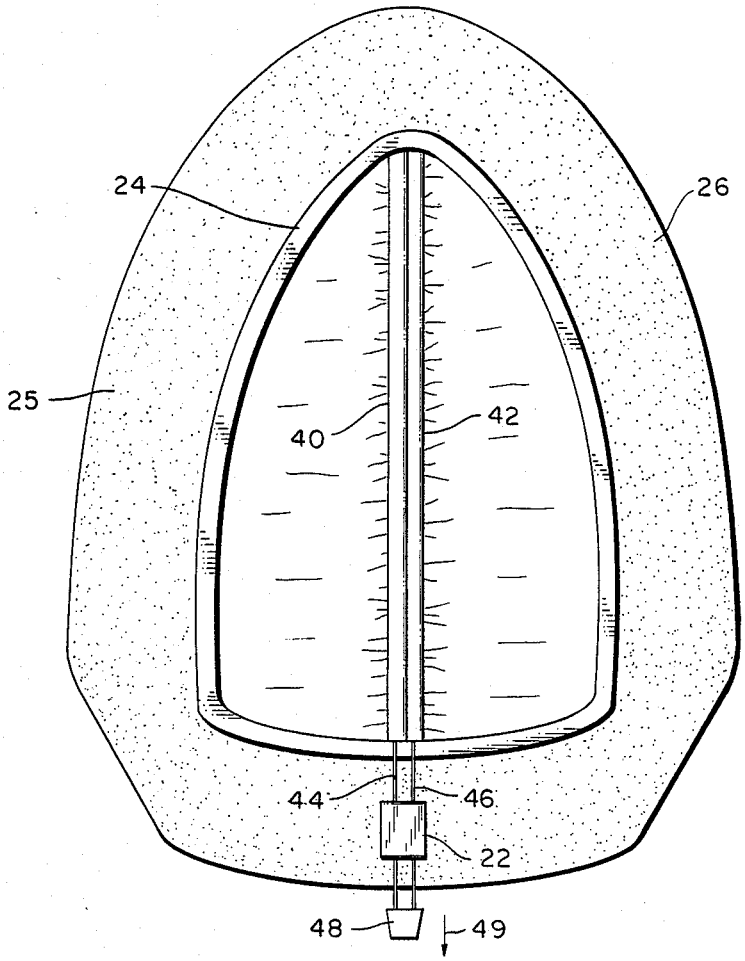
FIG. 4 is a view taken through line 4—4 of FIG. 3.

For completely enclosing the top of the waste collection bag 34, a sealing means 38, such as a drawstring and flaps or any other equivalent structure, is provided beneath the cushion top 12. Two flaps 40 and 42, formed of thin pliable plastic, are firmly and permanently attached to a bottom surface of the cushion 12 at one end. The attachment of the flaps to the cushion surrounds the center opening 13 of the cushion top 12. Each flap 40 and 42 includes drawstrings 44 and 46, respectively, which pass through and are slidably mounted in an inner peripheral fold of the flaps. The drawstrings 44 and 46 are contained within a fold 45 and 47, respectively, of each flap. One end of each drawstring is connected to the bottom surface of the cushion top 12. The other end of each drawing terminates at tab 48 located at an opposite end of the cushion top. As shown in FIG. 4, when tab 48 is pulled in the direction as shown by arrow 49, the flaps 40 and 42 converge and meet at the center of the opening 13, as shown in phantom in FIG. 3- and in solid lines in FIG. 4, to seal the top of the waste collection bag 34 and seal a pocket containing collected waste. The friction created between the drawstrings 44 and 46 and the flaps 40 and 42 is sufficient to maintain the flaps in their closed position once tab 48 is pulled to an extended position shown in FIG. 4.

In use, the adhesive backing 27 is peeled off to expose the adhesive 26 on the underside of cushion top 12. Top 12 is then positioned on the seat surface of bedpan 25. Rear end surface portions 14 and 16 of top 12 are wider than the corresponding front end surface portions 18 and 20. Cushion top 12 can, therefore, fit on bedpans having a variety of shapes and sizes. Top 12 is mounted onto the seat surface, and the inner rim 24 fits snugly inside the bedpan. As shown in FIG. 2, angular clip 22 snaps underneath the rim 23 of the bedpan 25 at the rear portion to further secure top 12 to the bedpan 25.

After use, the bag 34 is sealed by pulling on tab 48 to tighten drawstrings 44 and 46. Thereafter, the top 12 is lifted from the bedpan 25. This, in turn, lifts the waste collection bag 34 out of the bowl portion of the bedpan for disposal of the whole assembly 10.

Thus, using the device of the present invention with bedpans eliminates the required rigorous cleaning and sanitization between uses.

It is understood that the above description is intended by way of example only and is not intended to limit the present invention, except as set forth in the following claims.

What I claim is:

1. A disposable bedpan cushion and waste bag assembly comprising:

a cushion sized to fit onto the seat portion of a bedpan, said cushion including adhesive means for securing said cushion to the seat portion of a bedpan, and said cushion further including a center opening and a plastic rim surrounding said center opening;

a waste collection bag integrally attached to said cushion at said plastic rim to enclose said center opening, said waste collection bag being sized to occupy a portion of a bowl portion of the bedpan when said cushion is attached to the bedpan; and sealing means attached to said cushion above said waste collection bag for completely sealing said waste collection bag so that after use of the bedpan, said cushion and said waste collection bag are removed from the bedpan for disposal.

2. The assembly of claim 1, wherein said cushion further comprises a bottom layer of rigid plastic and a top layer of cotton fiber enclosed by a paper sheet.

3. The assembly of claim 1, wherein said waste collection bag is formed of pliable, strong plastic and includes an absorbent cotton liner along its inside bottom periphery.

4. The assembly of claim 1, wherein said cushion comprises front and rear end surface portions formed such that said rear end surface portions are wider than said front end surface portions.

5. The assembly of claim 1, wherein said cushion further comprises angular plastic clip means for attaching to the underside of the seat portion of the bedpan.

6. The assembly of claim 1, wherein said sealing means comprises two flaps attached to said cushion from below around said center opening and further including drawstrings which pass through and are slidably mounted in an inner fold of each of said flaps, so that when said drawstrings are pulled and tightened through the inner folds of said flaps, the flaps converge and meet at a line passing through the middle of said center opening to seal said waste collection bag.

7. A disposable bedpan cushion and waste bag assembly comprising:

a cushion sized to fit onto the seat portion of a bedpan, said cushion including adhesive means for securing said cushion to the seat portion of a bedpan, and said cushion further including a center opening and a plastic rim surrounding said center opening;

a waste collection bag integrally attached to said cushion at said plastic rim to enclose said center opening, said waste collection bag being sized to occupy a portion of a bowl portion of the bedpan when said cushion is attached to the bedpan; and sealing means attached to said cushion above said waste collection bag for completely sealing said waste collection bag, said sealing means including two flaps attached to said cushion from below and surrounding said center opening and further including drawstrings which pass through and are slidably mounted in an inner peripheral fold of each of said flaps so that when said drawstrings are pulled and tightened through the inner peripheral fold of said flaps, the flaps converge and meet at a line passing through the middle of said center opening to completely seal said waste collection bag.

8. The assembly of claim 7, wherein said cushion further comprises angular plastic clip means for attaching to the underside of the seat portion of the bedpan.

9. The assembly of claim 7, wherein said cushion further comprises a bottom layer of rigid plastic and a top layer of cotton fiber enclosed by a paper sheet.

10. The assembly of claim 7, wherein said waste collection bag is formed of pliable, strong plastic and includes an absorbent cotton liner along its inside bottom periphery.

11. A disposable bedpan cushion and waste bag assembly in combination with a bedpan comprising:

a bedpan including a top seat portion surrounding a center opening and having a bottom rim around the periphery of said center opening, and said bedpan further including a bowl for the collection of waste;

a cushion sized to fit onto the seat portion of said bedpan, said cushion including adhesive means for securing said cushion to the seat portion of said bedpan and said cushion further including a center opening to coincide with the center opening of said bedpan, a plastic rim surrounding said center opening, and an angular plastic clip which firmly fits underneath the bottom rim of said seat portion of said bedpan for firmly securing said cushion to said bedpan;

a waste collection bag integrally attached to said cushion at said plastic rim to enclose said center opening, said waste collection bag being sized to occupy a portion of the bowl of said bedpan when said cushion top is attached to the bedpan; and sealing means attached to said cushion above said waste collection bag for completely sealing said waste collection bag so that after use of the bedpan, said cushion and said waste collection bag are removed from the bedpan for disposal.

12. The assembly of claim 11, wherein said sealing means comprises two flaps attached to said cushion from below around said center opening and further includes drawstrings which pass through and are slidably mounted in an inner fold of said flaps so that when said drawstrings are pulled and tightened through the inner folds of said flaps, the flaps converge and meet at a line passing through the middle of said center opening to seal said waste collection bag.

13. The assembly of claim 11, wherein said waste collection bag is formed of thin pliable, strong plastic and includes an absorbent cotton liner along its inside bottom periphery.

* * * * *